US006896322B1

(12) United States Patent
Foy

(10) Patent No.: US 6,896,322 B1
(45) Date of Patent: May 24, 2005

(54) FOLDING CHAIR

(76) Inventor: Michael B. Foy, 913 Green Bay Rd., Winnetka, IL (US) 60093

( * ) Notice: Subject to any disclaimer, the term of this patent is extended or adjusted under 35 U.S.C. 154(b) by 110 days.

(21) Appl. No.: 10/619,844

(22) Filed: Jul. 15, 2003

Related U.S. Application Data

(60) Provisional application No. 60/397,273, filed on Jul. 19, 2002.

(51) Int. Cl.[7] ..... A47C 9/06
(52) U.S. Cl. ..... 297/14; 297/129; 297/56
(58) Field of Search ..... 297/14, 17, 56, 297/129

(56) References Cited

U.S. PATENT DOCUMENTS

| | | | | |
|---|---|---|---|---|
| 63,897 A | | 4/1867 | Howarth | |
| 162,447 A | | 4/1875 | Wilson | |
| 317,402 A | | 5/1885 | Merritt et al. | |
| 326,564 A | | 9/1885 | Hopkins | |
| 1,704,712 A | | 3/1929 | Silverman | |
| 1,800,107 A | | 4/1931 | Schmitt | |
| 2,497,412 A | * | 2/1950 | Larin | 297/14 |
| 2,583,372 A | * | 1/1952 | Hall | 297/14 |
| 4,415,201 A | | 11/1983 | Wang | |
| D314,871 S | | 2/1991 | Goetz | |
| 6,089,651 A | * | 7/2000 | Carmen | 297/56 |

* cited by examiner

*Primary Examiner*—Anthony D. Barfield
(74) *Attorney, Agent, or Firm*—John C. Shepard

(57) ABSTRACT

A folding chair assembly includes a frame having side, top and bottom walls, first and second pairs of legs, a seat between the legs, a first pair of leg pivots connecting respective legs together, a second pair of leg pivots engaging a first pair of cooperating slots for connecting first leg upper ends to the frame, a third pair of leg pivots for connecting second leg lower ends to the frame, a first pair of seat pivots for connecting the seat to second leg upper ends, and a second pair of seat pivots rearward on the seat of the first seat pivots engaging a pair of cooperating slots for connecting the seat to the first leg pair, whereby the chair is foldable from an open position with seat and legs extended to a closed position with seat and legs aligned within the frame. Pivoting arm rests can be provided.

41 Claims, 9 Drawing Sheets

10
25
45
23
32
53
46
26
12
30
31
38
77
35
54
37
58
61
57
64
60
55
70
15
71
17
18
20
76
21
41
40
73
67
43
33
68
74

7

123
132
199
110
146
112
130
193
192
184
126
195
196
125
155
137
154
177
164
135
157
158
160
170
131
115
171
181
176
183
161
120
118
138
114
117
121
168
174
133
143
173
7
167
140
141

FOLDING CHAIR

CROSS-REFERENCE TO RELATED APPLICATIONS

This application claims the benefit of Provisional Patent Application Ser. No. 60/397,273, filed Jul. 19, 2002.

BACKGROUND OF THE INVENTION

1. Technical Field

This invention relates generally to a folding chair and, more particularly, to a folding chair which is concealable within a relatively thin frame.

2. Background Art

In the prior art, folding chairs are well-known. The following United States patents are representative of the prior art and illustrate many of the devices that have been used in the past.

In Wang, U.S. Pat. No. 4,415,201, entitled "Folding Chair Having a Reversible Seat", issued Nov. 15, 1983, a folding chair is shown with a reversible seat and having sliding grooves on the inner side of the upper legs to facilitate up and down sliding movement of the seat while folding it for storage.

In Goetz, U.S. Pat. No. Des. 314,871, entitled "Foldable Chair", issued Feb. 26, 1991, a folding chair is shown with a seat movable along grooves formed in the upper legs.

In Merritt et al., U.S. Pat. No. 317,402, entitled "Folding Chair", issued May 5, 1885, a chair is shown which has two pairs of pivots and slide grooves enabling the chair to be folded flat. One set of grooves on the upper legs permits the seat back to slide therealong and the other set of grooves connecting the legs together permitting the legs to move linearly relative to each other.

In Howarth, U.S. Pat. No. 63,897, entitled "Folding Chair", issued Apr. 16, 1867, a folding chair is shown with grooves formed in the upper legs for guiding movement of the seat.

In Hopkins, U.S. Pat. No. 326,564, entitled "Folding Chair", issued Sep. 22, 1885, a flexible seat is supported by front and rear bars, the rear bar sliding in opposed grooves defined in spaced, upright back standards.

In Schmitt, U.S. Pat. No. 1,800,107, entitled "Folding Chair", issued Apr. 7, 1931, a metal chair is shown in which the seat is provided with sliding pivot blocks that move within channels defined in the chair leg.

In Silverman, U.S. Pat. No. 1,704,712, entitled "Folding Chair", issued Mar. 12, 1929, a metal chair is disclosed where the upper ends of the rear legs have pivots sliding within grooves defined in the sides edges of the seat.

In Wilson, U.S. Pat. No. 162,447, entitled "Adjustable Iron Chair", issued Apr. 20, 1875, the ends of the front legs of a chair are each slidable in a slot defined in a horizontal supporting bar.

The above patents illustrate a portion of the wide array of folding chairs that have been designed. Some are not durable or sturdy. Some cannot be folded completely flat to conserve storage space, while others are heavy to carry or difficult to fold and unfold. Thus, those chairs cannot be conveniently stored or concealed. Other chairs employ complex mechanisms and are costly to make.

BRIEF SUMMARY OF THE INVENTION

The present invention is directed to overcoming one or more of the problems as set forth above.

It is a general object of the present invention to provide a new and improved folding chair which is simple, inexpensive, compact, light, durable, sturdy, rigid, and multi-functional.

It is another object of the present invention to provide a folding chair which can be easily operated and can be folded or collapsed so as to have the thinnest profile possible.

It is an additional object of the present invention to provide a folding chair that can be concealed in a frame and hung on a wall, thus conserving floor space, the frame acting as a conventional-type picture frame to provide a display area for artwork, advertising or other desirable images thereby.

It is a further object of the present invention to provide a folding chair that has no locking mechanisms, gravity holding the chair in an open, unfolded position, as well as in a closed, folded position.

In an exemplary embodiment of the invention, a chair is provided which can be folded and concealed within a thin rectangular frame. The frame has side walls and top and bottom walls; the chair has first and second pairs of legs and a seat positioned between the legs. The frame and chair include a pair of pivots connecting respective legs together, a pair of pivots engaging a cooperating pair of sliding slots for connecting respective first leg upper ends to the frame, a pair of pivots for connecting the respective second leg lower ends to the frame, a pair of forward seat pivots for connecting the seat to respective second leg upper ends, a pair of pivots on the seat rearward of the forward seat pivots and engaging a cooperating pair of sliding slots for connecting the seat to the first leg pair, whereby the chair may be moved between an open position with the seat and legs extended from the frame and a closed position with the seat and legs all substantially aligned within the frame.

In another exemplary embodiment of the invention, arm rests are pivotally mounted to the frame for movement between an open position extended above and to the sides of the seat and a closed position within the frame.

BRIEF DESCRIPTION OF THE SEVERAL VIEWS OF THE DRAWINGS

The details of construction and operation of the invention are more fully described with reference to the accompanying drawings which form a part hereof and in which like reference numerals refer to like parts throughout.

In the drawings.

DETAILED DESCRIPTION OF THE INVENTION

Figure 1:
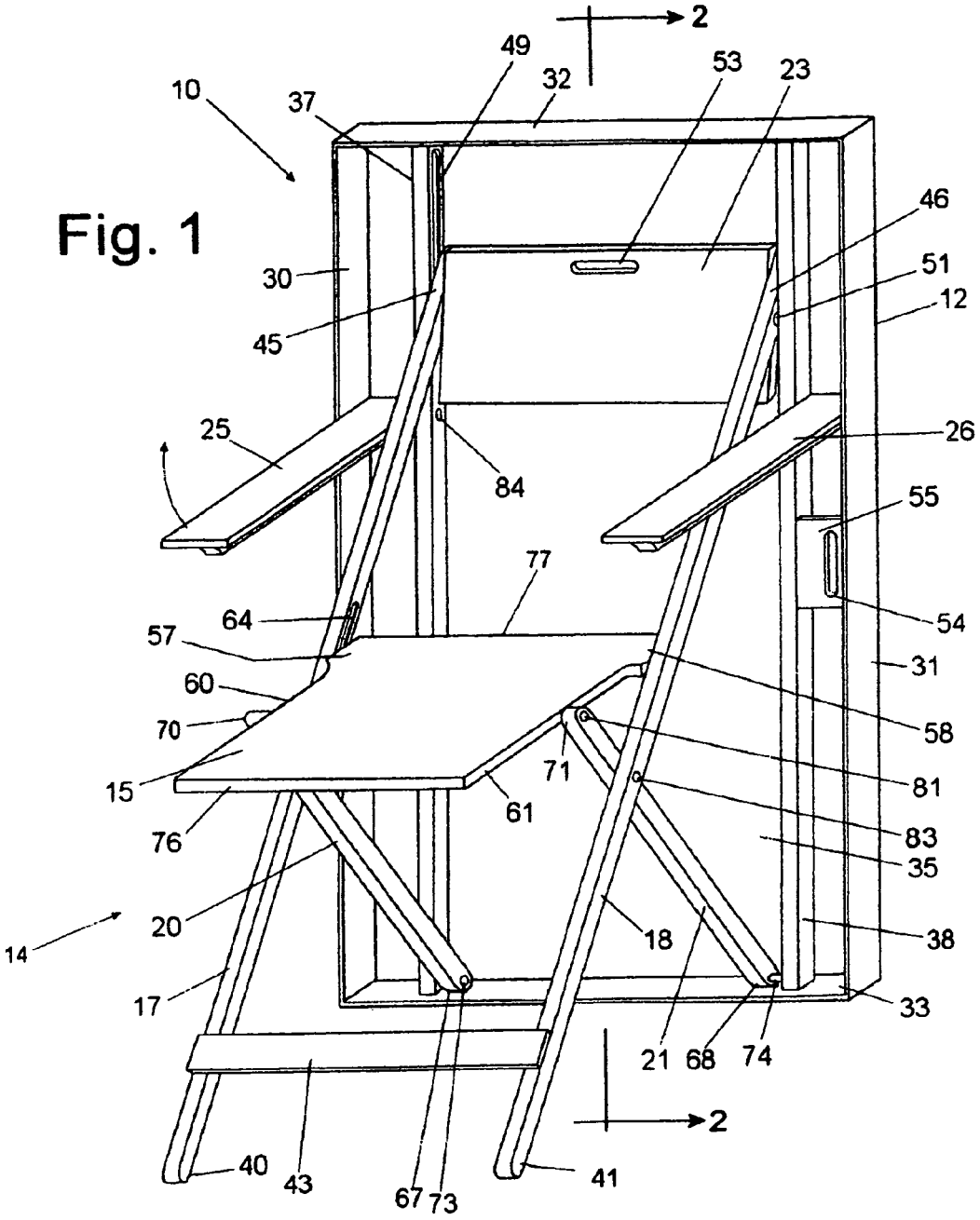
FIG. 1 is a front perspective view of a first embodiment of a folding chair constructed in accordance with the present invention in an open position extending from a frame.

Best Modes for Carrying Out the Invention

Referring to the drawings, a concealable chair, generally designated 10, constructed substantially in accordance with the present invention is seen to generally comprise three basic components: a thin, rectangular frame, generally designated 12; a folding chair, generally designated 14, including a seat 15, a first pair of spaced apart, relatively long, front legs 17 and 18, a second pair of spaced apart, relatively short, rear legs 20 and 21, and a back 23; and, a pair of arm rests 25 and 26.

Referring to FIG. 1, the rectangular frame 12 is seen to include opposed, spaced upright thin outer side walls 30 and 31, opposed, spaced thin top and bottom walls 32 and 33 extending between the corresponding upper and lower ends of the outer side walls 30 and 31, and a back panel 35. The L-shaped walls 30, 31, 32 and 33 and the back panel 35 mounted on the inwardly extending legs of the L-shaped walls define a relatively thin, rectangular box, or picture frame, with a shallow internal cavity (not numbered) with an open front. The thickness of the frame, i.e., the depth of the frame cavity as defined by length the upright portions of the L-shaped walls, should be as thin as possible, preferably, 1¾ inches or less. Spaced inwardly from and parallel to each of the side walls 30 and 31 within the frame 12 are a pair of opposed, spaced upright inner side walls 37 and 38, which extend between the top and bottom walls 32 and 33. As seen in FIG. 1, the inner side walls 37 and 38 may be of more substantial construction than the frame walls 30, 31, 32 and 33 to provide more rigid support for a seated person. The inner side walls 37 and 38 have slightly less depth than the frame walls 30, 31, 32 and 33, but there is no requirement that they be so.

The front legs 17 and 18 extend upwardly and rearwardly from their respective lower ends 40 and 41 resting on the supporting surface to a point adjacent to and inward of the upright inner side walls 37 and 38. Extending between the lower portions of the front legs is a horizontal cross brace member 43. The brace 43 is placed on the front face of the front legs 17 and 18 so as not to interfere with the folding action of the chair 14. The respective upper ends 45 and 46 of the front legs 17 and 18 each have lateral outwardly extending pivots 48 positioned in cooperatively-engaging, elongate sliding slots 49 and 50 defined in the respective inward faces of the inner upright walls 37 and 38. The slots 49 and 50 may extend through or partially into the side walls 37 and 38. The pivots 48 enable the legs 17 and 18 to rotate thereabout as the upper ends 45 and 46 of the legs 17 and 18 are moved upwardly and downwardly relative to the slots 49 and 50. The specific position and length of the slots 49 and 50 are selected to provide an appropriate range of movement between open and closed positions.

The chair back 23 is rotatably connected to the upper end portions of the long legs 17 and 18 by respective lateral outwardly extending pivots 51. The back 23 extends between the upper end portions of the long legs 17 and 18 to maintain them in spaced position. The back 23 may be tilted as necessary relative to the chair for the comfort of the user. Defined adjacent the upper edge of the midsection of the back 23 is a slot 53 adapted to receive a hook, nail, or other hanger so that the frame 12 with the folded chair 14 therein may be mounted to a wall (not shown), upright surface, or the like. To enable the frame 12 to be hung lengthwise, i.e., turned 90°, a similar slot 54 is defined in a bracket 55 provided adjacent the long outer side wall 31 intermediate the top and bottom walls 32 and 33.

As seen in FIG. 1, when the chair 14 is moved to a open position, the seat 15 lies is an generally horizontal orientation. The thin, rigid seat 15 has a generally rectangular configuration. However, the seat 15 has ears 57 and 58 extending laterally outward from either side thereof adjacent its rear edge 77 to define stepped-in portions 60 and 61 on either side edge continuing to its front edge 76, thereby defining a narrowed portion extending forward from the ears 57 and 58 to the front edge 76 of the seat 15. The ears 57 and 58 have respective lateral outwardly extending pivots 63 positioned in cooperatively-engaging, elongate sliding slots 64 and 65 defined in the respective midsection of the inward faces of the long legs 17 and 18. The slots 64 and 65 may extend through or partially into the inner side of each of the long legs 17 and 18. The pivots 63 enable the seat to rotate thereabout as the upper ends of the legs 17 and 18 are moved upwardly and downwardly. The specific position and length of the slots 64 and 65 are selected to provide an appropriate range of movement of the folding chair between open and closed positions.

The rear legs 20 and 21 extend upwardly and forwardly from their respective lower ends 67 and 68 to their respective upper ends 70 and 71 positioned on either side of the seat 15. The lower ends 67 and 68 of the rear legs 20 and 21 are each positioned inward of and spaced from the respective upright inner walls 37 and 38 approximately the width of the front legs 17 and 18. The lower ends 67 and 68 of the rear legs 20 and 21 have laterally extending pivots 73 and 74 rotatably connected to respective lower ends of the upright inner walls 37 and 38 to enable the rear legs 20 and 21 to rotate or swing relative to the frame 12 about a common horizontal axis. The upper ends 70 and 71 of the rear legs 20 and 21 are each positioned outward of the seat 15 and intermediate the seat's front and rear edges 76 and 77 within the stepped-in portions 60 and 61 and have lateral inwardly extending pivots 80 and 81 to enable the rear legs 20 and 21 to rotate relative to the seat 15 about a common horizontal axis. The position of the seat pivots 80 and 81 are forward of the pivots 63, which are rearward and spaced therefrom, to provide adequate support for the seat 15 and a user sitting thereon. The rear legs 20 and 21 are positioned inwardly of the respective front legs 17 and 18 with each pair of respective front and rear legs 17,20 and 18,21 being provided with pivots 82 and 83 to rotatably connect the respective short and long legs together at a point along their midsection intermediate their respective upper and lower ends and enable the legs to swing relative to one another about a common horizontal axis.

Figure 2:
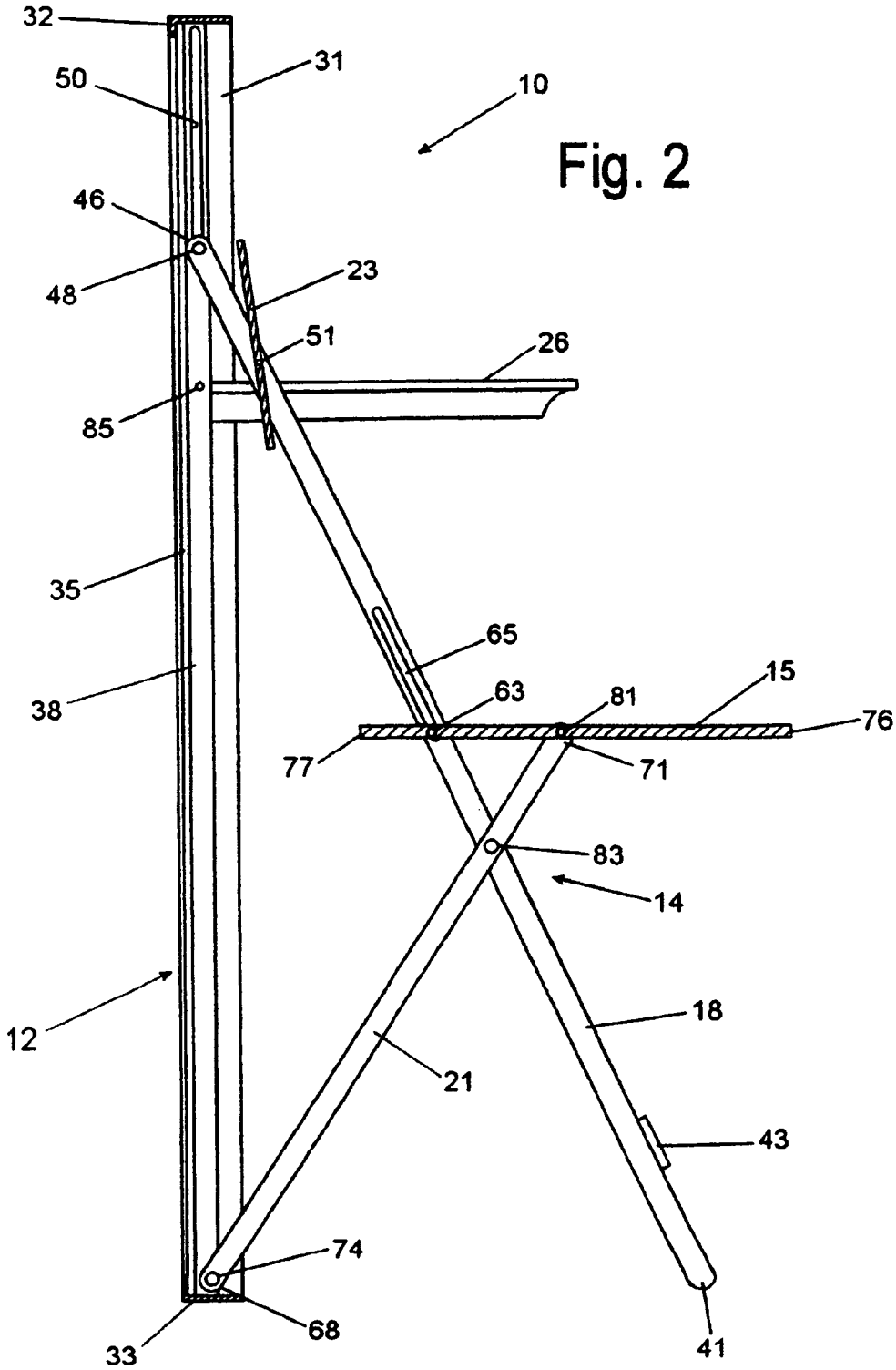
FIG. 2 is a vertical cross-sectional view of the folding chair shown in FIG. 1 taken along line 2—2.
Figure 4:
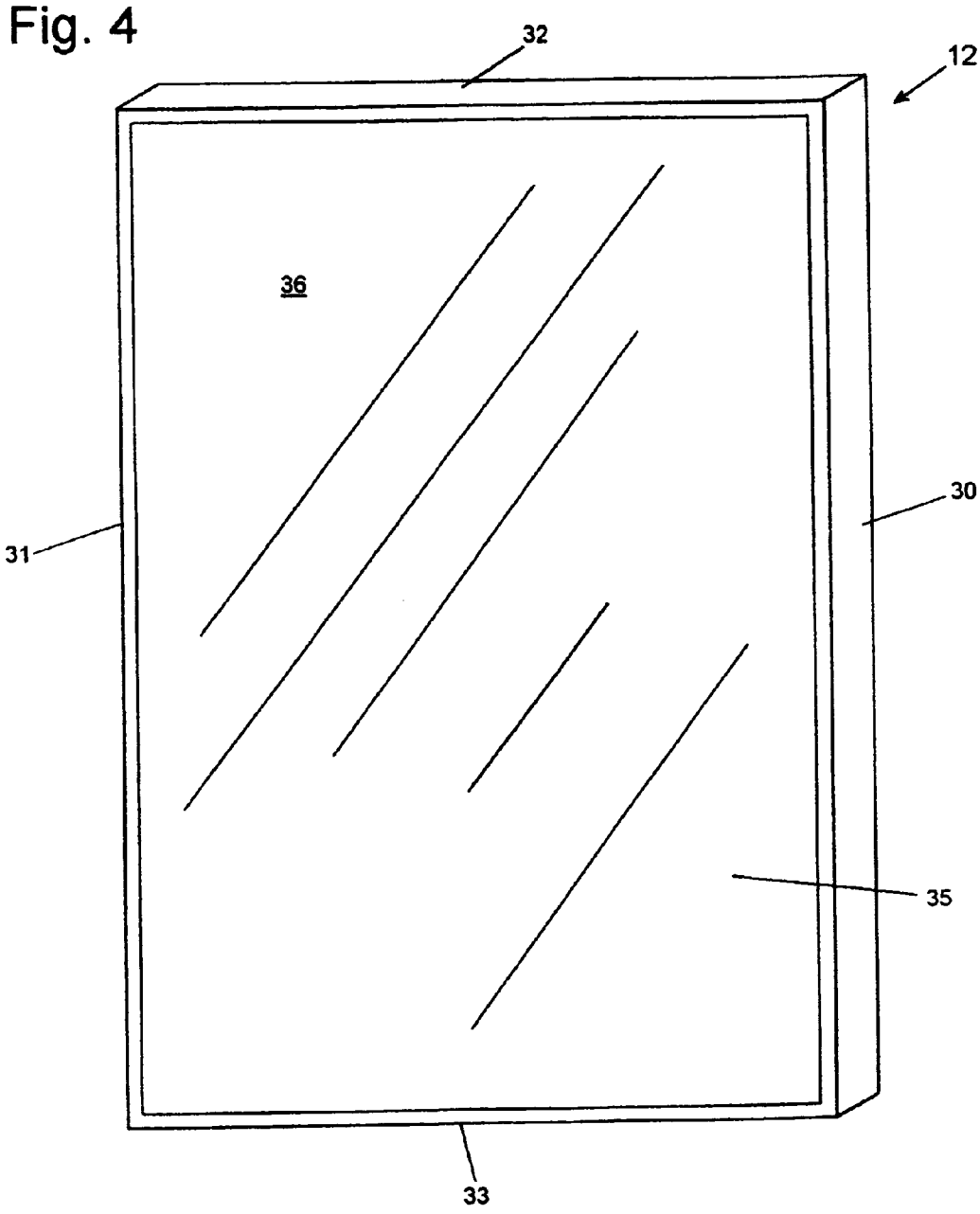
FIG. 4 is a rear perspective view of the folding chair of FIG. 1 showing the back of the frame.
Figure 5:
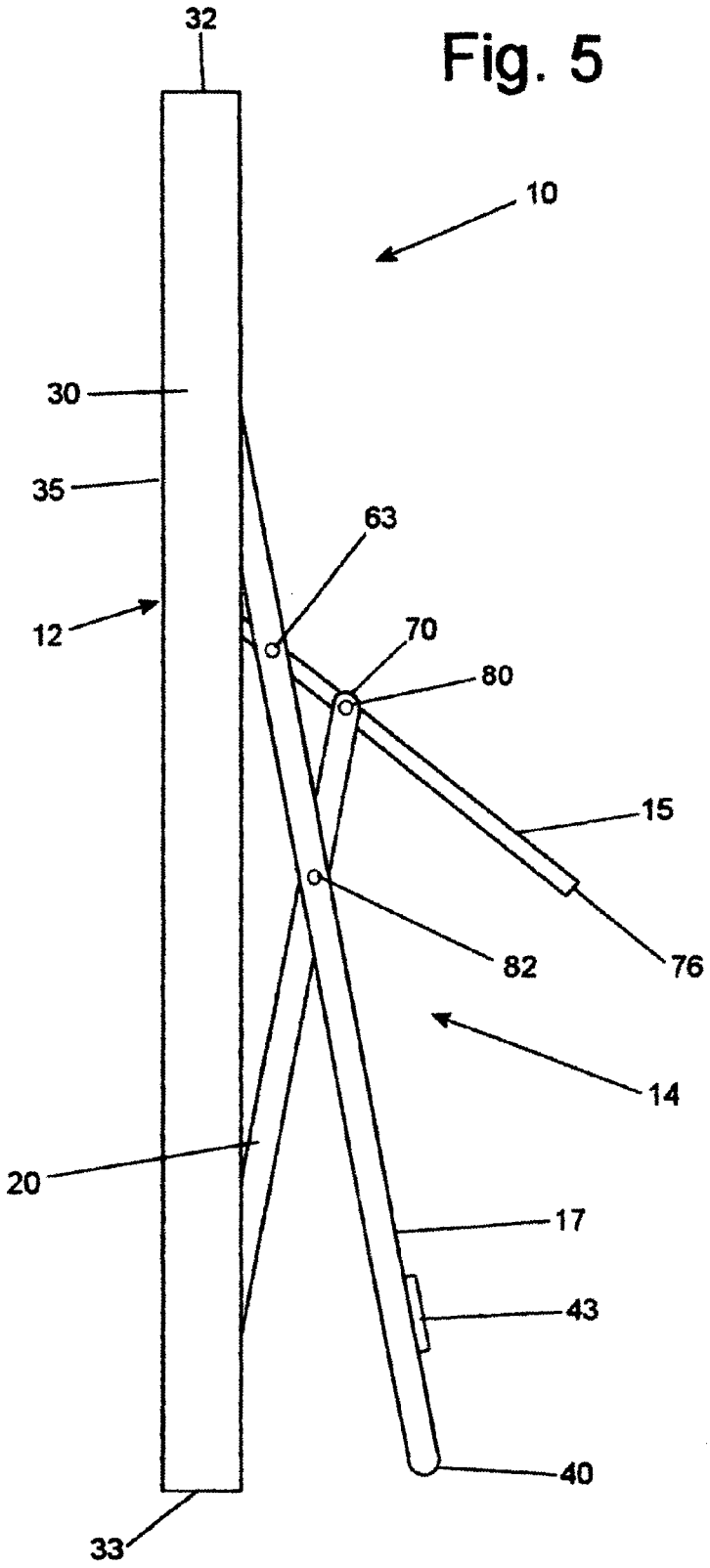
FIG. 5 is a side elevational view of the folding chair showing the chair partially extended from its frame.

The spaced, elongate arm rests 25 and 26 have a T-shaped cross-section and are disposed one on either side of the frame 12 between their respective inner and outer upright walls 30,37 and 31,38. The rearward ends of the arm rests 25 and 26 each are provided with a suitable pivot 84 and 85 so that they may be rotated between a closed, upright position within the frame 12 between the inner and outer upright walls as seen in FIG. 4 and an open, extended position as seen in FIGS. 1 and 2. In the open position, the free ends of the arm rests 25 and 26 extend outward from the frame 12 with the upper surfaces thereof disposed horizontally to act as left and right arm rests. Downward rotation of the arm rests 25 and 26 beyond the open position is limited by contact of the rear edges of the arm rests 25 and 26 with the inner surface of the back panel 35. It should be apparent that other methods of mounting the arms and limiting movement thereof are available.

Note that as an optional construction the arm rests may be eliminated entirely. In that case, the frame would be defined by the two inner upright walls, the bottom wall and the top wall. The outer side walls would be removed and the back panel would only extend between the side walls and the bottom and top walls. To provide a clean appearance, the slots for the leg pivots would not extend through the entire thickness of the side walls, but only have a depth sufficient for the pivot to function.

Figure 3:
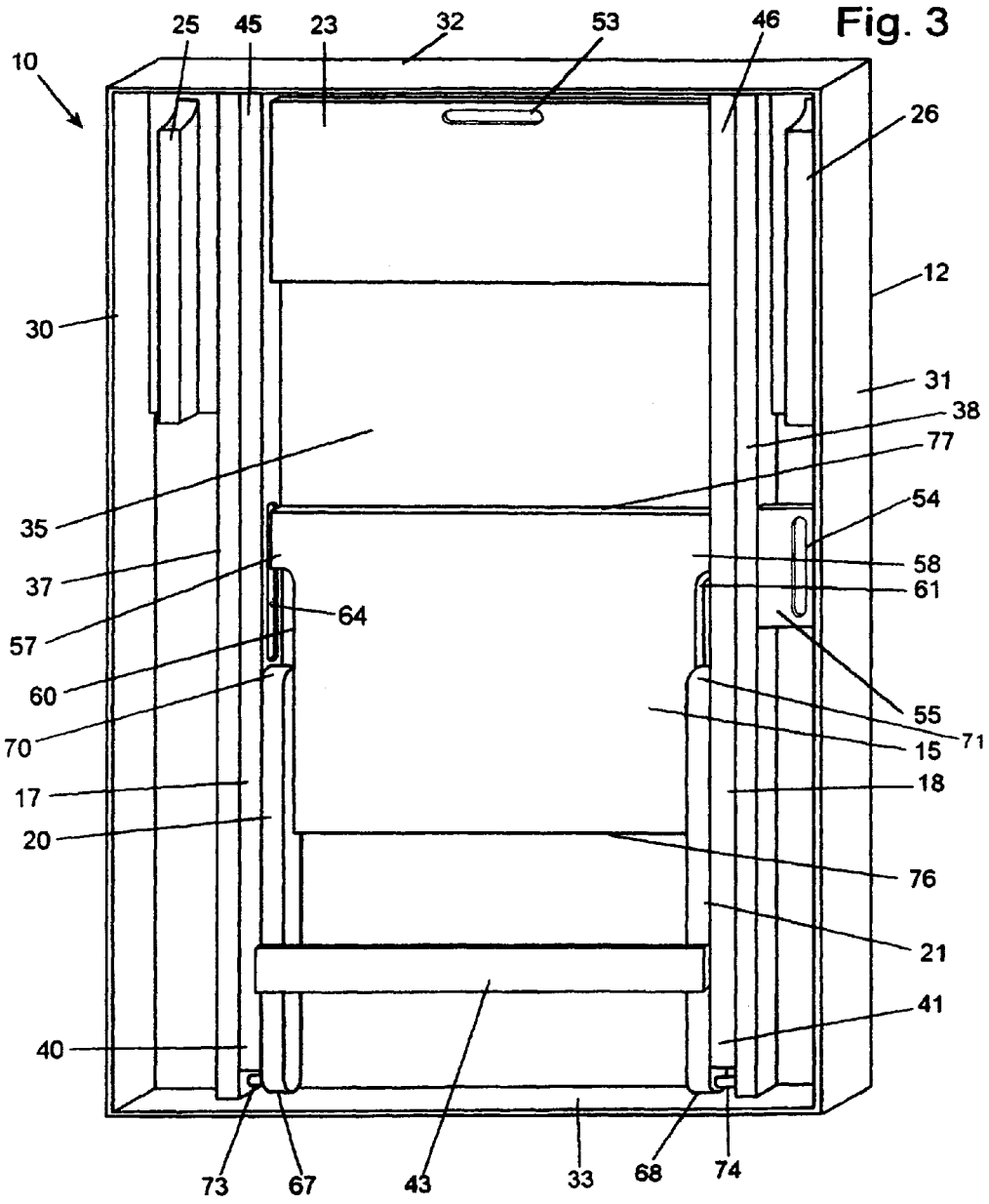
FIG. 3 is a front perspective view of the folding chair of FIG. 1 in a closed position within its frame.

In closed position as shown in FIG. 3, the seat 15 and legs 17, 18, 20 and 21 as well as the arm rests 25 and 26 are all positioned within the frame 12. In this position, the long front legs 17 and 18 are positioned inward of and next to the inner upright walls 37 and 38 and the short rear legs 20 and 21 are positioned inward of and next to the front legs 17 and 18. The rear legs 20 and 21 are spaced from the inner uprights walls 37 and 38 with long pivots 73 and 74. The length of each long leg 17 and 18 from the pivots 80 and 81 to the lower free end 40 and 41 is shorter than the length of the short legs 20 and 21 from the pivots 80 and 81 to the lower pivoted ends 67 and 68. The front legs 17 and 18 which are positioned between respective inner upright walls 37 and 38 and the rear legs 20 and 21 thereby overlying the rear leg pivots 73 and 74 when the chair is in a closed, folded position. The pivots 73 and 74 thereby extend between the inner upright walls 37 and 38 and the rear legs 20 and 21 below the lower ends 40 and 41 of the front legs 17 and 18. The rear edge 77 of the seat 15 is disposed between the front legs 17 and 18 and the front edge 76 of the seat 15 is disposed between the rear legs 20 and 21. The narrower stepped front portion of the seat 15 defined forward of the ears 57 and 58 permits the rear legs 20 and 21 to be placed between the front legs 17 and 18 which are connected directly to the rear of the seat 15.

When the folding chair 15 is folded to its fully closed position, the frame 12 can be stored or hung on a wall with the open side of the frame 12 facing the wall so that the parts of the folding chair 14 are hidden against the wall and the outer surface 36 of the back panel 35 is visible. The outer surface 36 of the back panel 35 can have artwork, advertising, or other visual displays to provide a pleasing or informative appearance.

When the chair 14 is to be unfolded, the front legs 17 and 18 are pulled out from the lower part of the frame 12. This, in turn, causes the upper ends 45 and 46 of the respective front legs 17 and 18 to rotate forwardly and move downwardly. Simultaneously, the rear legs 20 and 21 are pulled out with the respective upper ends 70 and 71 of the rear legs 20 and 21 being rotated forwardly and downwardly. Since the seat 15 is pivotally attached to both the front and rear legs, it is also rotated from its folded vertical position to its unfolded horizontal position when the legs are fully extended. Further, since the seat back 23 is attached to the front legs 17 and 18 at a position spaced from the pivoted upper ends 45 and 46, it will be positioned slightly forward of the open side of the frame 12. The arm rests 25 and 26 are optionally and individually lowered to their operative horizontal position upwardly of and to either side of the seat.

In a fully opened position, the seat 15 will be substantially horizontal with the lower ends 40 and 41 of the respective front legs 17 and 18 and the bottom wall 33 lying on approximately the same horizontal plane and the supporting floor or surface (not shown). The back panel 35 will be substantially upright or tilted +/−5° from vertical. The relative position of legs to the frame and to one another and the relative position and length of the slots to the pivots are determined by the need to achieve the above positions and by the need to have the chair 15 fold entirely within the frame 12, preferably, as thin and flat as possible.

In the unfolded, open position as seen in FIG. 1, the upper pivots 48 of the front legs 17 and 18 will rest at the bottom of the inner upright slots 49 and 50 and the seat pivots 63 will rest at the bottom of the front leg slots 64 and 65. Gravity holds and locks the chair 14 in an unfolded position. A person sitting in the chair 14 basically forces the pivots to their lowermost positions in their respective slots.

It is understood that the position of the pivots and slots may vary or may be adjusted in the various constructions of the folding chair built in accordance with the present invention depending of the size and orientation of the parts employed by the user.

As another example, the length of the arm rests can be extended without increasing the height of the frame, if the arm rests 84 and 85 are lowered, i.e., the pivots for the arm rests are positioned further down in the frame. Or, the arm rests can be raised, if the arm rests are shortened.

The chair may be made of wood, plastic, or metal as desired. Extruded plastic, aluminum, or steel provide a pleasing appearance and an appropriate finish. The inner side walls to provide additional structural strength to support the seat and the user may be made of stronger material or be shaped or configured to have a cross-sectional area greater than the cross-sectional area of the outer side walls. The back panel may be made of any relatively thin rigid or flexible material, such as wood, plastic, plexiglass, cardboard, canvas, or metal. The seat and seat back may be covered with a layer of sorbothane, other polyurethane material, or any other suitable material to provide a comfortable cushion.

Figure 6:
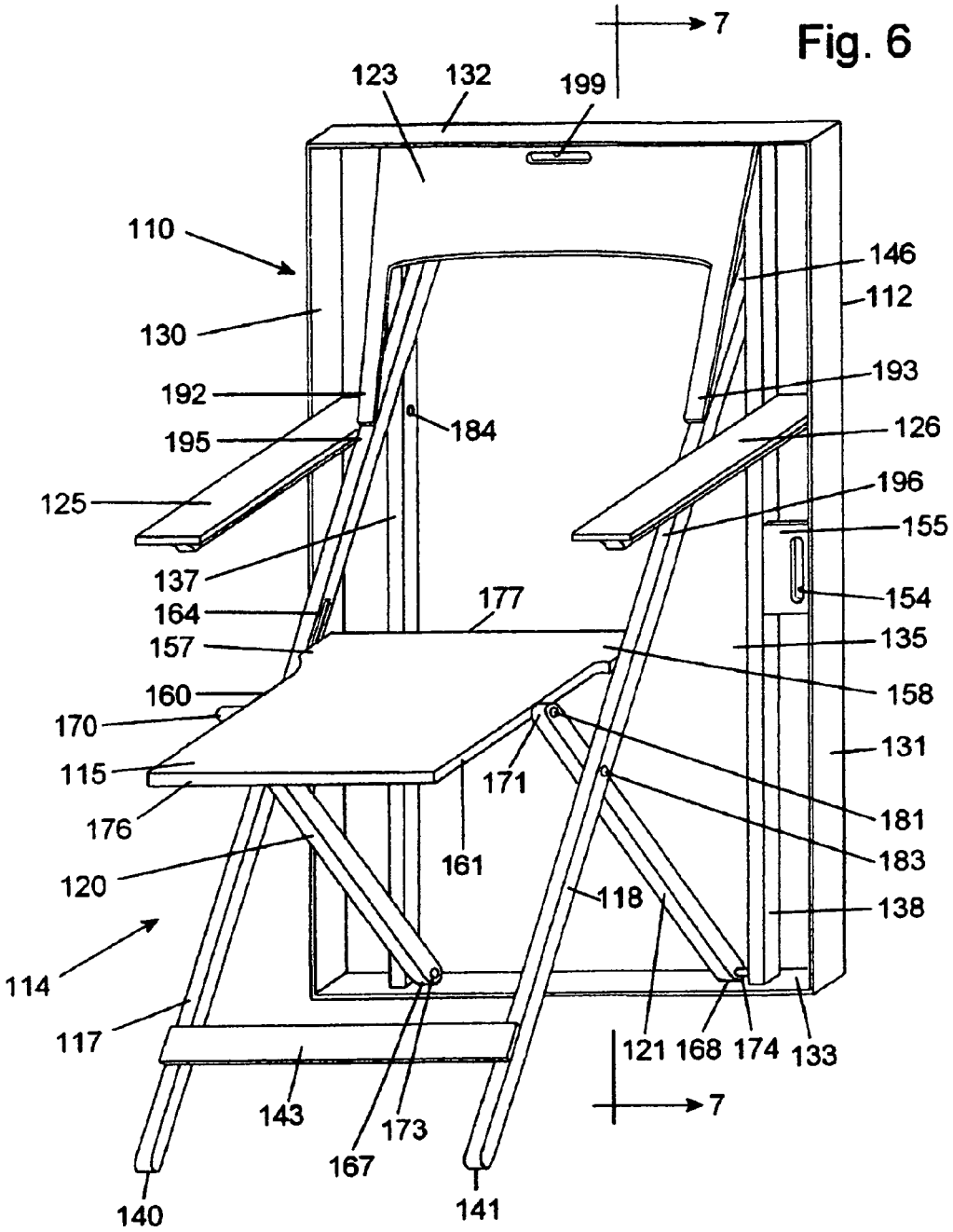
FIG. 6 is a front perspective view of a second embodiment of a folding chair constructed in accordance with the invention in an open position extending from a frame.
Figure 7:
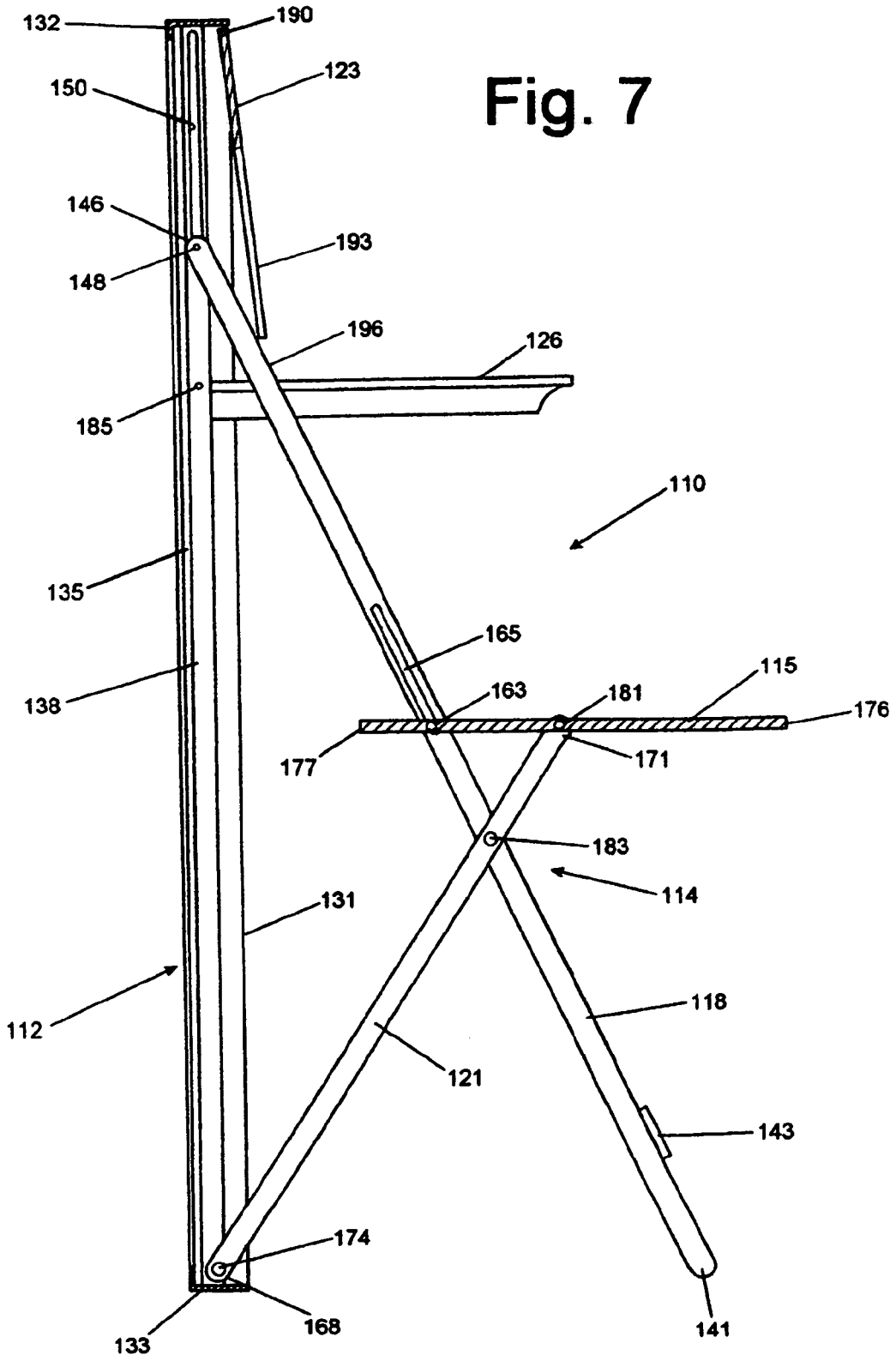
FIG. 7 is a vertical cross-sectional view of the folding chair shown in FIG. 6 taken along line 7—7.

A second embodiment of the chair and frame assembly, generally designated 110, is shown in FIGS. 6 and 7 and is seen to generally comprise three basic components: a thin, rectangular frame, generally designated 112; a folding chair, generally designated 114, including a seat 115, a first pair of spaced apart, relatively long, front legs 117 and 118, a second pair of spaced apart, relatively short, rear legs 120 and 121, and a back 123; and, a pair of arm rests 125 and 126.

The rectangular frame 112 is seen to include opposed, spaced upright thin outer side walls 130 and 131, opposed, spaced thin top and bottom walls 132 and 133 extending between the corresponding upper and lower ends of the outer side walls 130 and 131, and a back panel 135. The L-shaped walls 130, 131, 132 and 133 and the back panel 135 mounted on the inwardly extending legs of the L-shaped walls define a relatively thin, rectangular box, or picture frame, with a shallow internal cavity and an open front. Spaced inwardly from and parallel to each of the side walls 130 and 131 within the frame 112 are a pair of opposed, spaced upright inner side walls 137 and 138, which extend between the top and bottom walls 132 and 133.

The front legs 117 and 118 extend upwardly and rearwardly from their respective lower ends 140 and 141 resting on the supporting surface to a point adjacent to and inward of the upright inner side walls 137 and 138. A cross brace 143 is provided between the front legs 117 and 118 for rigidity and for use as a possible foot rest. The respective upper ends 146 of the front legs 117 and 118 each have lateral outwardly extending pivots 148 positioned in cooperatively-engaging, elongate sliding slots 150 defined in the respective inward faces of the inner upright walls 137 and 138.

The seat 115 has ears 157 and 158 extending laterally outward from either side thereof adjacent its rear edge 177 to define stepped-in portions 160 and 161 on either side edge continuing to its front edge 176, thereby defining a narrowed portion extending forward from the ears 157 and 158 to the front edge 176 of the seat 115. The ears 157 and 158 have respective lateral outwardly extending pivots 163 positioned in cooperatively-engaging, elongate sliding slots 164 and 165 defined in the respective midsection of the inward faces of the long legs 117 and 118.

The rear legs 120 and 121 extend upwardly and forwardly from their respective lower ends 167 and 168 to their respective upper ends 170 and 171 positioned on either side of the seat 115. The lower ends 167 and 168 of the rear legs 120 and 121 are each positioned inward of and spaced from the respective upright inner walls 137 and 138 approximately the width of the front legs 117 and 118. The lower ends 167 and 168 of the rear legs 120 and 121 have laterally extending pivots 173 and 174 rotatably connected to respective lower ends of the upright inner walls 137 and 138 to enable the rear legs 120 and 121 to rotate or swing relative to the frame 112. The upper ends 170 and 171 of the rear legs 120 and 121 are each positioned outward of the seat 115 and intermediate the seat's front and rear edges 176 and 177 within the stepped-in portions 160 and 161 and have lateral inwardly extending pivots 180 and 181 to enable the rear legs 120 and 121 to rotate relative to the seat 115. The position of the seat pivots 181 are forward of the pivots 163, which are rearward and spaced therefrom, to provide adequate support for the seat 115 and a user sitting thereon. The rear legs 120 and 123 are positioned inwardly of the respective front legs 117 and 118 with each pair of respective front and rear legs 117,120 and 118,121 being provided with pivots 183 to rotatably connect the respective short and long legs together at a point along their midsection intermediate their respective upper and lower ends and enable the legs to swing relative to one another.

The spaced, elongate arm rests 125 and 126 have a T-shaped cross-section and are disposed one on either side of the frame 112 between their respective inner and outer upright walls 130,137 and 131,138. The rearward ends of the arm rests 125 and 126 each are provided with a suitable pivot 185 so that they may be rotated between a closed, upright position within the frame 112 between the inner and outer upright walls.

The back rest 123 is pivotally connected, as by opposed pivots 190, with the inner side walls 137 and 138, or by hinges (not shown), adjacent the top wall 132 and has a pair of spaced side portions 192 and 193 which slide along the front surfaces 195 and 196 of the upper portions of the front legs 117 and 118. When the front legs 117 and 118 are moved outward to an open position, the back rest 123 is pivoted outwardly relative to the frame 112 to tilt the back rest 123 to a comfortable position. When the chair is moved to a closed position, the back rest 123 is moved within the frame 112 against the inner side walls 137 and 138 which the back rest 123 overlaps. The inner side walls 137 and 138 have a depth less than the thickness of the outer side walls 130 and 131 to accommodate the back rest 123 within the frame cavity. Formed at the top of the back rest 123 intermediate the sides is a hanger receiver slot 199 adapted to receive a wall mount so that the chair frame assembly may be mounted to an upright wall. To enable the frame 12 to be hung lengthwise, a similar slot 154 is defined in a bracket 155 provided adjacent the long outer side wall 131 intermediate the top and bottom walls 132 and 133.

Figure 8:
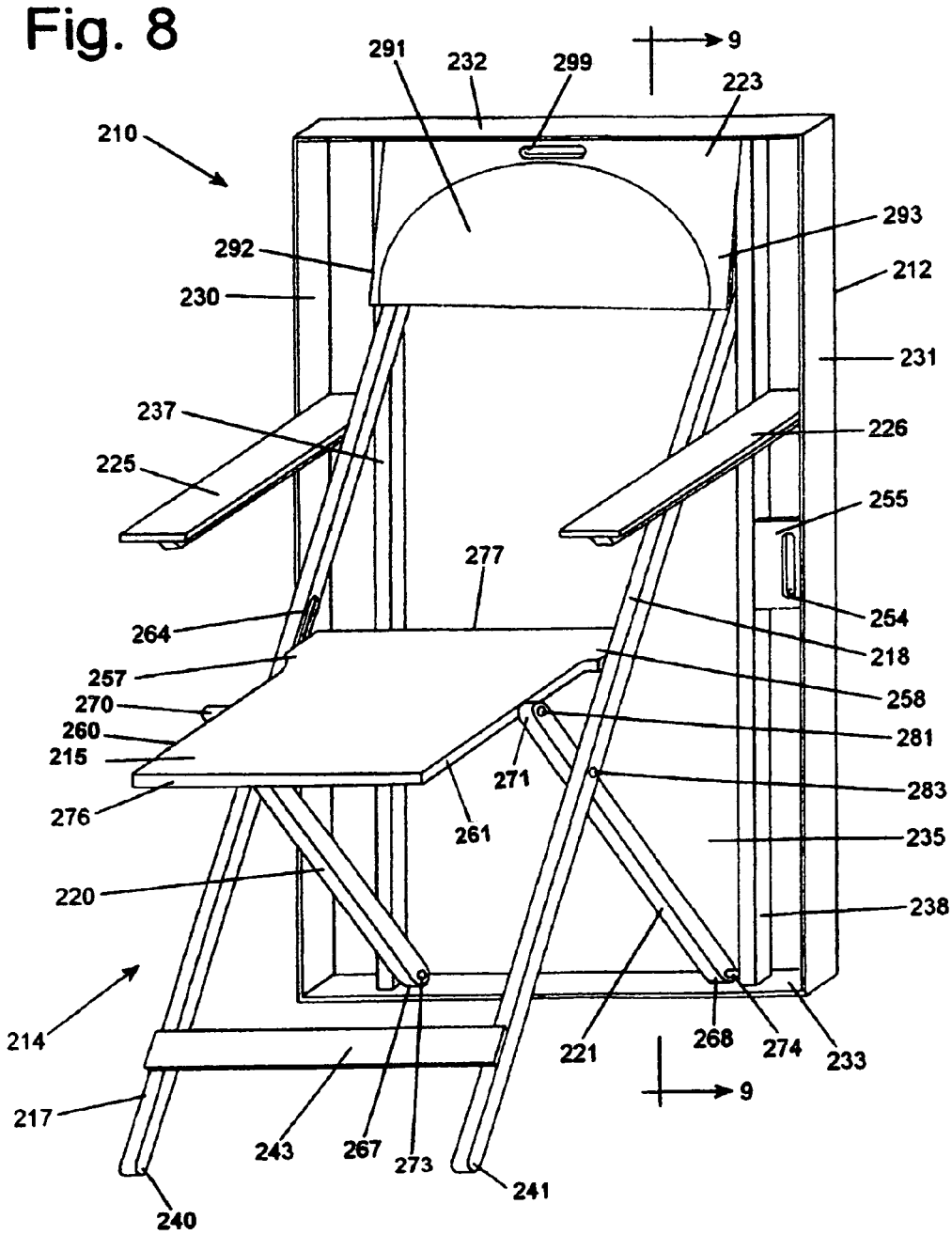
FIG. 8 is a front perspective view of a third embodiment of a folding chair constructed in accordance with the invention in an open position extending from a frame.
Figure 9:
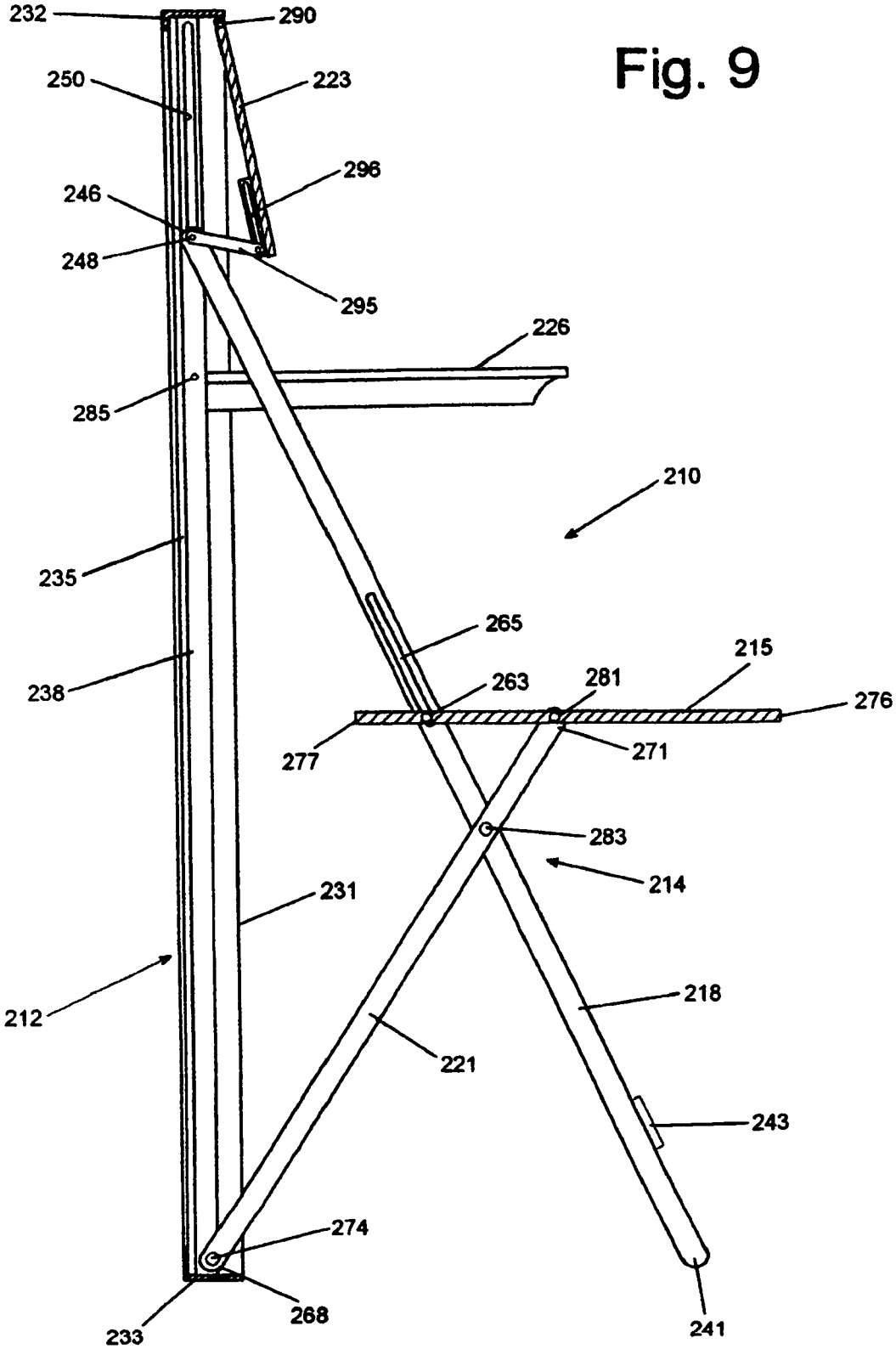
FIG. 9 is a vertical cross-sectional view of the folding chair shown in FIG. 8 taken along line 9—9.

A third embodiment of the chair and frame assembly, generally designated 210, is shown in FIGS. 8 and 9 and is seen to generally comprise three basic components: a thin, rectangular frame, generally designated 212; a folding chair, generally designated 214, including a seat 215, a first pair of spaced apart, relatively long, front legs 217 and 218, a second pair of spaced apart, relatively short, rear legs 220 and 221, and a back 223; and, a pair of arm rests 225 and 226.

The rectangular frame 212 is seen to include opposed, spaced upright thin outer side walls 230 and 231, opposed, spaced thin top and bottom walls 232 and 233 extending between the corresponding upper and lower ends of the outer side walls 230 and 231, and a back panel 235. The L-shaped walls 230, 231, 232 and 233 and the back panel 235 mounted on the inwardly extending legs of the L-shaped walls define a relatively thin, rectangular box, or picture frame, with a shallow internal cavity and an open front. Spaced inwardly from and parallel to each of the side walls 230 and 231 within the frame 212 are a pair of opposed, spaced upright inner side walls 237 and 238, which extend between the top and bottom walls 232 and 233.

The front legs 217 and 218 extend upwardly and rearwardly from their respective lower ends 240 and 241 resting on the supporting surface to a point adjacent to and inward of the upright inner side walls 237 and 238. A cross brace 243 is provided between the front legs 217 and 218 for rigidity and for use as a possible foot rest. The respective upper ends 246 of the front legs 217 and 218 each have lateral outwardly extending pivots 248 positioned in cooperatively-engaging, elongate sliding slots 250 defined in the respective inward faces of the inner upright walls 237 and 238.

The seat 215 has ears 257 and 258 extending laterally outward from either side thereof adjacent its rear edge 277 to define stepped-in portions 260 and 261 on either side edge continuing to its front edge 276, thereby defining a narrowed portion extending forward from the ears 257 and 258 to the front edge 276 of the seat 215. The ears 257 and 258 have respective lateral outwardly extending pivots 263 positioned in cooperatively-engaging, elongate sliding slots 264 and 265 defined in the respective midsection of the inward faces of the long legs 217 and 218.

The rear legs 220 and 223 extend upwardly and forwardly from their respective lower ends 267 and 268 to their respective upper ends 270 and 271 positioned on either side of the seat 215. The lower ends 267 and 268 of the rear legs 220 and 221 are each positioned inward of and spaced from the respective upright inner walls 237 and 238 approximately the width of the front legs 217 and 218. The lower ends 267 and 268 of the rear legs 220 and 221 have laterally extending pivots 273 and 274 rotatably connected to respective lower ends of the upright inner walls 237 and 238 to enable the rear legs 220 and 221 to rotate or swing relative to the frame 212. The upper ends 270 and 271 of the rear legs 220 and 221 are each positioned outward of the seat 215 and intermediate the seat's front and rear edges 276 and 277 within the stepped-in portions 260 and 261 and have lateral inwardly extending pivots 281 to enable the rear legs 220 and 221 to rotate relative to the seat 215. The position of the seat pivots 281 are forward of the pivots 263, which are rearward and spaced therefrom, to provide adequate support for the seat 215 and a user sitting thereon. The rear legs 220 and 221 are positioned inwardly of the respective front legs 217 and 218 with each pair of respective front and rear legs

217,220 and 218,221 being provided with pivots 283 to rotatably connect the respective short and long legs together at a point along their midsection intermediate their respective upper and lower ends and enable the legs to swing relative to one another.

The spaced, elongate arm rests 225 and 226 have a T-shaped cross-section and are disposed one on either side of the frame 212 between their respective inner and outer upright walls 230,237 and 231,238. The rearward ends of the arm rests 225 and 226 each are provided with a suitable pivot 285 so that they may be rotated between a closed, upright position within the frame 212 between the inner and outer upright walls.

The back rest 223 is pivotally connected, as by opposed pivots 290, with the inner side walls 237 and 238, or by hinges (not shown), adjacent the top wall 232 and has a concave center section 291 for receiving a user's back and a pair of spaced side portions 292 and 293. A linkage 295, one at each side of the back rest 223, is connected between the pivot pin 246 and a slide slot 296, carried at the rear of the side portions of the back rest 223. When the front legs 217 and 218 are moved outward to an open position, the back rest 223 is pivoted outwardly relative to the frame 212 to tilt the back rest 223 to a comfortable position. When the chair is moved to a closed position, the back rest 223 is moved within the frame 212 against the inner side walls 237 and 238 which the back rest 223 overlaps. The inner side walls 237 and 238 have a depth less than the thickness of the outer side walls 230 and 231 to accommodate the back rest 223 within the frame cavity. Formed above the concave back section 291 in a flat surface of the back rest 223 is a hanger receiver slot 299 adapted to receive a wall mount so that the chair frame assembly may be mounted to an upright wall. To enable the frame 212 to be hung lengthwise, a similar slot 254 is defined in a bracket 255 provided adjacent the long outer side wall 231 intermediate the top and bottom walls 232 and 233.

INDUSTRIAL APPLICABILITY

From the foregoing, it should be apparent the folding chair described herein is simple, compact and inexpensive, yet is a convenient and reliable item.

Other aspects, objects and advantages of this invention can be obtained from a study of the drawings, the disclosure and the appended claims.

What is claimed is:

1. A chair foldable between a closed, collapsed storage position and an open, extended sitting position comprising:

a frame having spaced side walls and top and bottom walls extending between respective ends of said side walls;

a first pair of spaced legs having upper and lower ends;

a second pair of spaced legs having upper and lower ends located between and inwardly of said first pair of spaced legs;

a first pair of pivot means intermediate the ends of said first and second legs for rotatably connecting one of each pair of legs together;

a second pair of pivot means adjacent the upper ends of each of said first legs cooperatively engaging a first pair of sliding slots defined by said frame for rotatably connecting said first pair of legs to said frame and enabling movement along said slot;

a third pair of pivot means adjacent the lower ends of each of said second legs for rotatably connecting said second pair of legs to said frame adjacent its bottom wall;

a seat positioned between said first pair of legs and between said second pair of legs, said seat having a supporting surface defined between front and rear edges;

a fourth pair of pivot means one on either side of said seat intermediate its front and rear edges for rotatably connecting said seat to the upper ends of said second pair of legs; and, a fifth pair of pivot means rearward on said seat of said fourth pivot means cooperatively engaging a second pair of sliding slots defined one in each of the first pair of legs for rotatably connecting said seat to said first pair of legs and enabling motion along said slot, whereby the chair may be moved between a closed, folded position in said frame with the first and second pair of legs and the seat collapsed to a substantially flat condition and an open position with said seat extended and first leg lower portions and said frame bottom wall locatable on a supporting surface.

2. The chair of claim 1 wherein the thickness of said first and second pair of legs and said seat is less than the depth of the frame side walls whereby the chair lies entirely within the frame when the chair is collapsed and moved to its closed position.

3. The chair of claim 1 wherein said frame further includes a back wall extending between said top, bottom and side walls to define a relatively shallow cavity.

4. The chair of claim 1 wherein the top, bottom and side walls are made of relatively thin material having a generally L-shaped cross section, the leg portion of the L-shaped walls extending inwardly and the upright portion of the L-shaped walls extending not more than 1¾ inches to define a relatively shallow cavity not more than 1¾ inches deep.

5. The chair of claim 4 wherein said frame further includes a back wall extending between said top, bottom and side walls and overlapping the leg portions of the L-shaped walls to define said cavity.

6. The chair of claim 1 wherein said frame further includes a second pair of spaced side walls extending between said top and bottom walls, one pair of side walls being disposed inwardly of the other pair of side walls to define inner and outer side walls adjacent each side of said frame, said first and second pairs of legs being connected to the frame on either side thereof between said inner side walls.

7. The chair of claim 6 wherein said second pair of legs are each spaced from respective inner side walls with said second pair of legs being respectively disposed between said inner side walls and said first pair of legs with the distance from said first pivot means to the lower end of each of said first legs being less than the distance from said first pivot means to said third pivot means.

8. The chair of claim 6 wherein said inner side walls are structurally stronger than said outer side walls to support the weight of a user sitting on the seat.

9. The chair of claim 6 further including a pair of spaced, elongate arm rests, each pivotally connected to said frame between respective inner and outer side walls for rotational movement between a closed position within the frame and an open position extending from the frame upwardly from and to either side of the seat.

10. The chair of claim 1 further including a pair of spaced, elongate arm rests, each pivotally connected to said frame for rotational movement between a closed position within the frame and an open position extending from the frame upwardly from and to either side of the seat.

11. The chair of claim 1 wherein said seat is relatively rigid.

12. The chair of claim 1 further including a back rest extending between said first pair of legs.

13. The chair of claim 12 wherein said back rest is pivotally connected to said first pair of legs adjacent their respective upper ends.

14. The chair of claim 1 further including a back rest pivotally connected to said frame being disposed forward of said first pair of legs with said back rest having a lower portion slidable along said first pair of legs, whereby said back rest lower portion is moved outwardly relative to said frame as said first pair of legs are rotated forwardly from a closed position to an open position.

15. The chair of claim 1 further including a back rest pivotally connected to said frame being disposed forward of said first pair of legs, a linkage having one end pivotally connected to a first leg upper end portion, and a slot pin joint connecting the second end of said linkage and a lower portion of the back rest, whereby said back rest lower portion is moved relative to said frame by said linkage as said first pair of legs are rotated forwardly from a closed position to an open position.

16. The chair of claim 1 wherein said chair further includes hanger receiving means for hanging said frame on a substantially upright surface with the top wall positioned generally horizontally at the top thereof.

17. The chair of claim 16 wherein said chair further includes hanger receiving means for hanging said frame on a substantially upright surface with the top wall positioned generally vertically at one side thereof.

18. A chair foldable between a closed, collapsed storage position and an open, extended sitting position comprising:

a frame including spaced top and bottom walls, a pair of spaced side walls joined respectively to said top and bottom walls;

a first pair of spaced legs having upper and lower end portions;

a second pair of spaced legs having upper and lower end portions, each of said second legs being pivotally connected to a respective one of said first pair of legs intermediate their respective end portions for rotation relative to each other, each of said second leg lower end portions being pivotally connected to said frame adjacent its bottom wall;

a first pair of sliding pin joints for respectively connecting said first leg upper end portions to said frame with said first legs being movable up and down and pivotable relative to said frame as the first leg lower end portions are rotated between an inward closed position within the frame and an outward open position;

a seat for supporting a user positioned between said first legs and second legs and having front and back edges, said seat being pivotally connected intermediate its front and back edges to respective second leg upper end portions for rotation relative to said second pair of legs;

a second pair of sliding pin joints for connecting said seat adjacent its back edge to each of said first legs intermediate their upper and lower end portions with said seat being movable along said first legs and pivotable relative thereto as said seat is rotated relative to said second pair of legs, whereby the chair may be moved between a closed, folded position with the first and second pair of legs and the seat collapsed to a substantially flat condition and an open position with said seat extended and first leg lower end portions and said frame bottom wall locatable on a supporting surface.

19. The chair of claim 18 wherein the thickness of said first and second pair of legs and said seat is less than the depth of the frame side wall whereby the chair lies within the frame when the chair is collapsed and moved to its closed position.

20. The chair of claim 18 wherein said frame further includes a back wall extending between said top, bottom and side walls to define a relatively shallow cavity.

21. The chair of claim 18 wherein said top, bottom and side walls are made of relatively thin material having a generally L-shaped cross section, the leg portion of the L-shaped walls extending inwardly and the upright portion of the L-shaped walls extending not more than 1¾ inches to define a relatively shallow cavity not more than 1¾ inches deep.

22. The chair of claim 21 wherein said frame further includes a back wall extending between said top, bottom and side walls and overlapping the leg portions of the L-shaped walls to define said cavity.

23. The chair of claim 21 wherein said frame further includes a second pair of spaced side walls extending between said top and bottom walls, one pair of side walls being disposed inwardly of the other pair of side walls to define inner and outer side walls adjacent each side of said frame, said first and second pairs of legs being connected to said frame on either side thereof between said inner side walls.

24. The chair of claim 23 wherein each of said first sliding pin joints includes a pin carried by the first leg and a slot formed in a frame inner side wall adapted to receive the pin.

25. The chair of claim 24 wherein each of said second sliding pin joints includes a pin carried by the first leg and a slot formed in a respective first leg intermediate its upper and lower end portions adapted to receive the pin.

26. The chair of claim 23 wherein said inner side walls are structurally stronger than said outer side walls to support the weight of a user sitting on the seat.

27. The chair of claim 23 further including a pair of spaced, elongate arm rests, each pivotally connected to said frame between respective inner and outer side walls for rotational movement between a closed position within the frame and an open position extending from the frame upwardly from and to either side of the seat.

28. The chair of claim 18 further including a pair of elongate arm rests, each pivotally connected to said frame for rotational movement between a closed position within the frame and an open position extending from the frame upwardly from and to either side of the seat.

29. The chair of claim 18 further including a back rest extending between said first leg upper portions.

30. The chair of claim 29 wherein said back rest is pivotally connected to said first leg upper portions.

31. The chair of claim 18 further including a back rest pivotally connected to said frame and being disposed forward of said first pair of legs with said back rest having a lower portion slidable along said first pair of legs, whereby said back rest lower portion is moved outwardly relative to said frame as said first pair of legs are rotated forwardly from a closed position to an open position.

32. The chair of claim 18 further including a back rest pivotally connected to said frame and being disposed forward of said first pair of legs, a linkage having one end pivotally connected to a first leg upper end portion, and a slot pin joint connecting a second end of said linkage and a lower portion of the back rest, whereby said back rest lower portion is moved relative to said frame by said linkage as said first pair of legs are rotated forwardly from a closed position to an open position.

33. The chair of claim 18 wherein said second pair of legs are disposed inwardly and between said first pair of legs.

34. The chair of claim 18 wherein said respective first and second pairs of legs are connected by pivots for rotation about a common horizontal axis.

35. The chair of claim 34 wherein said seat and said second pair of legs are connected by pivots for rotation about a second common horizontal axis.

36. The chair of claim 18 wherein said seat is relatively rigid.

37. The chair of claim 18 wherein said chair further includes hanger receiving means for hanging said frame on a substantially upright surface with the top wall positioned generally horizontally at the top thereof.

38. The chair of claim 37 wherein said chair further includes hanger receiving means for hanging said frame on a substantially upright surface with the top wall positioned generally vertically at one side thereof.

39. A chair foldable between a closed, collapsed storage position and an open, extended sitting position comprising:

a frame including spaced top and bottom walls, a pair of spaced side walls joined respectively to said top and bottom walls, and a back wall extending between said top, bottom and side walls, said top, bottom and side walls being made of relatively thin material having a generally L-shaped cross section, the leg portion of the L-shaped walls extending inwardly and the upright portion of the L-shaped walls extending not more than 1¾ inches, the back wall overlapping the leg portions of the L-shaped walls to define a cavity not more than 1¾ inches deep;

a second pair of spaced side walls extending between said top and bottom walls, said second pair of said side walls being disposed inwardly of said first pair of side walls to define inner and outer side walls adjacent each side of said frame, said inner side walls being structurally stronger than said outer side walls;

a first pair of spaced legs having upper and lower end portions;

a second pair of spaced legs having upper and lower end portions, said second pair of legs being disposed inwardly and between said first pair of legs, each of said second legs being pivotally connected to a respective one of said first pair of legs intermediate their respective end portions for rotation relative to each other, said second pair of legs being pivotally connected to said frame on either side thereof adjacent its bottom wall between said inner side walls;

a first pair of sliding pin joints for respectively connecting said first leg upper end portions to said inner side walls with said first legs being movable up and down and pivotable relative to said frame as the first leg lower end portions are rotated between an inward closed position in the frame and an outward open position;

a relatively rigid seat for supporting a user positioned between said first legs and second legs and having front and back edges, said seat pivotally connected intermediate its front and back edges to respective second leg upper end portions for rotation relative to said second pair of legs;

a second pair of sliding pin joints for connecting said seat adjacent its back edge to each of said first legs intermediate their upper and lower end portions with said seat being movable along said first legs and pivotable relative thereto as said seat is rotated relative to said second pair of legs;

the thickness of said first and second pairs of legs and said seat being less than the depth of the frame side walls, whereby the chair may be moved between a closed, folded position with the first and second pair of legs and the seat collapsed to a substantially flat condition within said cavity and an open position with said seat extended and first leg lower end portions and said frame bottom wall locatable on a generally horizontal supporting surface; and, hanger receiving means for hanging said frame on a substantially upright surface.

40. The chair of claim 39 further including a back rest extending between said first upper leg portions.

41. The chair of claim 39 further including a pair of spaced, elongate arm rests, each pivotally connected to said frame between respective inner and outer side walls for rotational movement between a closed position within the frame and an open position extending from the frame upwardly from and to either side of the seat.

* * * * *